US011319787B2

(12) United States Patent
Serate et al.

(10) Patent No.: US 11,319,787 B2
(45) Date of Patent: May 3, 2022

(54) SYSTEM AND METHOD FOR DIRECT STEAM INJECTION INTO SLURRIES

(71) Applicant: Canadian Natural Upgrading Limited, Calgary (CA)

(72) Inventors: Duane Serate, Calgary (CA); Haifeng Liu, Calgary (CA); Jose Abreu, Calgary (CA); John Ajedegba, Calgary (CA)

( * ) Notice: Subject to any disclaimer, the term of this patent is extended or adjusted under 35 U.S.C. 154(b) by 521 days.

(21) Appl. No.: 16/153,400

(22) Filed: Oct. 5, 2018

(65) Prior Publication Data

US 2019/0242227 A1 Aug. 8, 2019

Related U.S. Application Data

(60) Provisional application No. 62/627,039, filed on Feb. 6, 2018.

(51) Int. Cl.

| | |
|---|---|
| ***B01F 5/00*** | (2006.01) |
| ***E21B 43/24*** | (2006.01) |
| ***B01F 25/431*** | (2022.01) |
| ***B01F 25/313*** | (2022.01) |
| *B01F 23/237* | (2022.01) |

(Continued)

(52) U.S. Cl.

CPC ..... *E21B 43/24* (2013.01); *B01F 25/3131* (2022.01); *B01F 25/431* (2022.01); *B01F 23/23767* (2022.01); *B01F 25/4316* (2022.01); *B01F 2025/911* (2022.01); *B01F 2101/49* (2022.01)

(58) Field of Classification Search

CPC ..... B01F 5/0451; B01F 5/061; B01F 2003/04936; B01F 2005/0005; B01F 2005/0625; B01F 2215/0081; E21B 43/24

See application file for complete search history.

(56) References Cited

U.S. PATENT DOCUMENTS 3,923,288 A 12/1975 King
4,116,809 A 9/1978 Kizior (Continued)

FOREIGN PATENT DOCUMENTS

CA 2962067 A1 10/2017
WO 2012/126118 A1 9/2012

OTHER PUBLICATIONS

Song, C-H et al. Characterization of Direct Contact Condensation of Steam Jets Discharging Into a Subcooled Water; Korea Atomic Energy Research Institute; Taejon, Republic of Korea. pp. 21-37; 2000.

(Continued)

*Primary Examiner* — Anshu Bhatia

(74) *Attorney, Agent, or Firm* — Parlee McLaws LLP; Susan L. Rancourt

(57) ABSTRACT

A system and method is provided for direct condensing steam heating of oil sands process slurry streams including viscous bitumen froth and tailings products streams. Slurry viscosities greater than that of water increase cavitation and vibration issues. High solids content exacerbate component erosions. Difficult, and competing, steam and slurry interactions are managed by steam nozzle arrangements and management of steam injection at sub-sonic velocities based on a ratio of the slurry back-pressure Pb and steam supply delivery pressure Po.

23 Claims, 12 Drawing Sheets

(51) Int. Cl.
*B01F 25/00* (2022.01)
*B01F 101/49* (2022.01)

(56) References Cited

U.S. PATENT DOCUMENTS

| | | | | |
|---|---|---|---|---|
| 4,208,136 | A | 6/1980 | King | |
| 4,255,125 | A * | 3/1981 | Auclair | F23D 11/102 239/402 |
| 5,223,148 | A | 6/1993 | Tipman et al. | |
| 6,082,713 | A * | 7/2000 | King | B01F 5/0451 261/79.2 |
| 6,132,079 | A | 10/2000 | King | |
| 6,800,116 | B2 | 10/2004 | Stevens et al. | |
| 7,137,731 | B2 | 11/2006 | Carson | |
| 7,914,670 | B2 | 3/2011 | Gaston et al. | |
| 8,342,486 | B2 | 1/2013 | Smith | |
| 8,685,210 | B2 | 4/2014 | Gaston et al. | |
| 2009/0079107 | A1* | 3/2009 | Abiru | B01F 5/0451 264/216 |
| 2011/0174592 | A1 | 7/2011 | Gaston et al. | |
| 2014/0011147 | A1 | 1/2014 | Van Der Merwe | |
| 2017/0291151 | A1 | 10/2017 | Berglund | |

OTHER PUBLICATIONS

Tailings Solvent Recovery Units; Oil Sands Magazine; Sep. 30, 2018; http://www.oilsandsmagazine.com/technical/mining/froth-treatment/paraffinic/tsru-tailings-solvent-recovery-unit.

Froth Treatment Explained; Oil Sands Magazine; Sep. 30, 2018 http://www.oilsandsmagazine.com/technical/mining/froth-treatment.

Clerx, N. Experimental Study of Direct Contact Condensation of Steam in Tubulent Duct Flow; Eindhoven: Technische Universiteit Eindhoven DOI: 10.6100/IR691389; Jan. 1, 2010.

De With, A. et al. Regimes of Direct Contact Condensation of Steam Injected Into Water; Int. J. Multiphysics 1(2): 271 (2007).

Wu, X. et al. Experimental Study on Steam Plume and Temperature Distribution for Sonic Steam Jet; J. Phys. Conf. Ser 147 (2009) 012079.

Lindstrom, M. Injector Nozzle Hole Parameters and Their Influence on Real Di Diesel Performance; Thesis Department of Machine Design; Jan. 2009.

Komax; Steam Heater With High Heating Efficiency & No Moving Parts; Jan. 19, 2018 https://web.archive.org/web/20150228012515/http://www.komax.com:80/industry/bitumen-froth/.

Komax Inline Steam Heater; https://www.control-specialities.com/komax-inline-steam-heater.html; Jan. 19, 2018.

Komax; Steam Pulp Heater; Jan. 19, 2018 http://www.komax.com/steam-pulp-heater/.

Komax; Tailings Solvent Recovery Heater; Jan. 19, 2018; http://www.komax.com/tailings-solvent-recovery-heater/.

* cited by examiner

SYSTEM AND METHOD FOR DIRECT STEAM INJECTION INTO SLURRIES

CROSS-REFERENCE TO RELATED APPLICATIONS

This application claims the benefit of U.S. Provisional Patent application Ser. No. 62/627,039, filed Feb. 6, 2018, the entirety of which is incorporated herein by reference.

FIELD

Embodiments herein relate to the heating and mixing of fluids, and more particularly to the mixing of steam and slurries, such as oil sands processing slurries including hydrocarbon rich bitumen froth through to predominantly water-fraction viscous slurries such as tailings solvent recovery streams.

BACKGROUND

In transporting viscous fluids which may contain abrasives, such as various slurries from oil sands processing operations, it is common to heat the slurry by injecting steam in-line with the viscous fluid and subject the fluid to static mixing. The steam releases latent heat energy to heat the fluid to a desired temperature in preparation for downstream processes.

In the oil sands processing industry, conventional methods of injecting steam into slurry are subject to a number of problems that result in poor heat transfer, vibration and premature failure of the process interface of slurry, steam and mixing. Steam hammering vibration can be caused by the implosion of oversize steam bubbles as steam condenses.

Particular to such oil sand slurries, the process conditions can result in a lowering of the pressure and flashing of the hydrocarbon content. The steam and formation of hydrocarbon bubbles and their violent collapse is known as cavitation which cause localized erosion and corrosion. Vibration resulting from cavitation can cause damage to adjacent piping and connections, which may necessitate costly repairs and pose a risk to nearby personnel and the environment. Further, the viscosity of the slurry can also affect steam mixing dynamics.

Attempts have been made to manage steam injection parameters, such as to introduce the steam at supersonic velocities, to reduce vibration. However, while dealing with a vibration problem, supersonic velocities have been determined to introduce accelerated erosion of the steam injection and static mixing components.

Static mixing modules are frequently employed to increase the total contact area between the injected steam and bitumen froth so as to provide more efficient mixing thereof, thereby accelerating temperature transfer.

One such mixing module is that taught in U.S. Pat. No. 4,208,136 to Komax, which describes a cylindrical module having plurality of mixing channels extending therethrough. Steam and froth are introduced to a mixer comprising radially spaced channels separated by angularly rotated mixing elements or vanes for inducing a rotational motion of the steam and bitumen froth passing therethrough to promote a more efficient mixing of the condensing steam and froth. Applied to the heating of bitumen froth, the aforementioned and combined steam injection and mixer have been noted to wear out prematurely, sometimes in mere days or hours. Such mixing vanes can cause channeling of the abrasive fluid mixture and vane failure, including directing the mixture into the sidewall of downstream piping and causing accelerated erosion of the pipe wall. Such channeling has resulted in vibration and erosion that is detrimental to the structural integrity of the froth pipe, potentially wearing through the pipe wall and allowing high-pressure, high-temperature fluid to leak into the environment.

Pipe failures present an extreme risk of injury to nearby personnel and environmental damage. There remains a need to maximum heat transfer from steam to streams ubiquitous in oil sands processing, whilst avoiding vibration and erosion of the components and prolonging their service life.

SUMMARY

In oil sands processing, the extraction process produces a hydrocarbon rich bitumen froth slurry of between about 50 to 60% bitumen, 20-40% water and 10-14% solids. The bitumen froth is treated by settling, known as froth setting which typically includes the addition of a naphthenic or a paraffinic solvent. After froth settling treatment, a bitumen and solvent product is produced and a tailings underflow slurry or tailings product results which is directed as a tailings feedstrwam for solvent recovery. The tailings product forms a tailings solvent recovery feed stream which includes a hydrocarbon depleted stream of predominately water, some residual bitumen, solvent, and a large fine solids content.

Depending on the solvent chosen as a diluent, the tailings solvent recovery feeds stream can comprise in the order of 3-5% naphtha or as high as 15 to 20% pentane/hexane paraffinic solvent. The residual bitumen may be as low as 2-4% and 6-8% respectively. Solids content is quite high in both instances in the order of 15-20%.

Further due to the nature of the constituents of the slurry streams, including the presence of variable amounts of heavy bitumen hydrocarbons and fine solids, the viscosity of the streams is greater than that of water (about 1 mPa·s or cP), tailings feed in the order of about 8-10 cP, an order of magnitude greater than that of water. Bitumen froth has a viscosity of about 8000 to 10,000 cP, or about three orders of magnitude greater than that of the tailings feed and about four orders of magnitude greater than that of water.

Applicant has mitigated component failures in direct steam condensation heating and process stream mixing applications through control of the steam injection velocities and management of the steam injection.

Generally, with maximization of the mean time between failure of the steam injection and mixing components as one objective, Applicant has determined that management of the steam injection to ensure sub-sonic discharge velocities, and of the steam plume to minimize vibration, results in long life of the injection and mixing components. In instances of moderate viscosity, in the range of one order of magnitude greater than that of water, a static mixer may not be required downstream of the injector so as to achieve the process heating requirements. Absent said static mixer, the erosion issue is significantly abated.

At sub-sonic velocities, erosion is mitigated and for high viscosity slurries, the steam nozzle is specified for increased cross-flow mixing with the process Applicant predetermines a nominal mass of superheated steam based on the system heat balance for the given mass rates of the slurry stream and temperature conditions. Further, the required mass rate of flow of steam for the heat balance requirements is delivered at an steam slurry interface, introduced to the flow of the slurry based on a ratio of the slurry back-pressure Pb and steam supply delivery pressure Po. Variation in the process slurry rates are managed by adjusting steam supply pressure according to the Pb/Po ratio.

In one broad embodiment, a system is provided for direct steam injection to heat a viscous oil sand process slurry, the slurry comprising hydrocarbons, water and solids and a viscosity at least 5 times that of water or greater. The system includes a first slurry conduit having a first bore for conducting the slurry therealong at a first slurry pressure. A steam conduit has a steam outlet situate within first slurry conduit, for co-injecting superheated steam therefrom and directed downstream into the viscous slurry at a second steam pressure, a pressure ratio of the first pressure to the second pressure being between 0.55 and about 0.9.

The embodiment results in sub-sonic velocities and in embodiments, the velocity of the steam is controllable to remain within the pressure ratio as slurry characteristics may vary including rate and composition. The slurry is characterized by viscosities that are typically one to four orders of magnitude greater than that of water.

In embodiments, the steam is discharged from a nozzle, the nozzle comprising the steam outlet and a conical deflector therein for forming an annular steam discharge gap therebetween. The steam discharge nozzle can have a circular discharge end and the conical deflector is a right circular cone concentric within for forming the annular discharge gap therebetween.

In another broad aspect, a method is provided for direct steam injection to heat the viscous oil sand process slurry comprising flowing the slurry along a first conduit having an axis and injecting steam axially into the slurry from a nozzle at a superheated steam supply pressure and temperature. One also measures a slurry pressure of the slurry upstream of the steam injection. The velocity of the injected stream from the nozzle is maintained at a subsonic to about a sonic velocity. One can maintain the velocity at sub-sonic by adjusting the nozzle to maintain an operational ratio of the slurry to steam pressure is between 0.55 to about 0.9. Alternatively, on can maintaining or adjust the supply steam pressure wherein an operational ratio of the slurry to steam pressure is between about 0.55 to about 0.9.

BRIEF DESCRIPTION OF THE DRAWINGS

FIG. 6A is a cross-sectional view of an alternative embodiment of the system wherein the steam outlet is a perforated plate for steam to flow through;

FIG. 6B is an end view of one form of the perforated plate fit t to the steam outlet according to FIG. 6A.

DESCRIPTION

Figure 1:
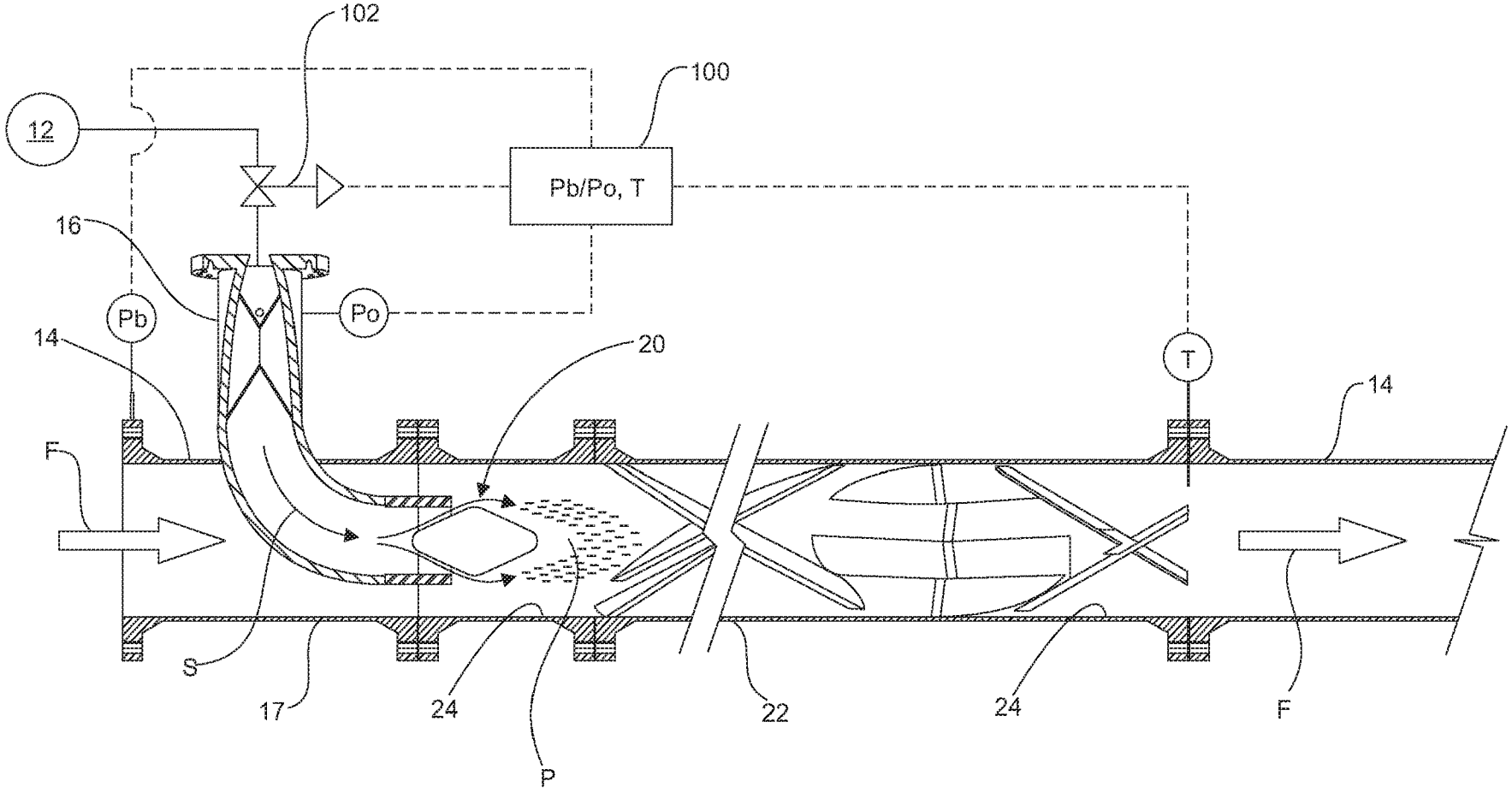
FIG. 1 illustrates a control system for managing steam injection velocities into oil sands process slurries based on process operational variations.

According to embodiments herein, a system is provided for direct steam condensation heating of fluids in a variety of onerous fluid stream conditions, such as for mixing steam and hydrocarbon slurries having various viscosities greater than that of water. Slurries include hydrocarbon-based slurries such as bitumen froth, and froth settling unit tailings product slurries typical of oil sands operations practiced in the Athabasca oil sands regions of Northern Alberta Canada. Such slurries with entrained solids are difficult to handle including factors has as abrasive entrained solids and variable viscosities that can affect the steam mixing mechanisms.

In oil sands processing, the extraction process produces a bitumen froth slurry of between about 50 to 60% bitumen, 20-40% water and 10-14% solids. After treatment froth treatment, typically admixed with a solvent, a bitumen product is produced and a tailings slurry results which is directed for solvent recovery. The tailings solvent recovery feed slurry stream includes residual bitumen, solvent, and a large fine solids content. Depending on the solvent, the tailings solvent recovery feeds stream can comprise in the order of 3-5% naphtha and as high as 15 to 20% pentane/hexane paraffinic solvent. The residual bitumen may be as lows as 2-4% and 6-8% respectively. Solids content is quite high in both instances in the order of 15-20%.

Further due to the nature of the constituents of the slurry streams, the viscosity of the streams is greater than that of water (about 1 mPa·s or cP), tailings feed in the order of about 8-10 cP, an order of magnitude greater than that of water. Bitumen froth has a viscosity of about 8000 cP, or about three orders of magnitude greater than that of the tailings feed and about four orders of magnitude greater than that of water.

Applicant has noted failures in the known existing mixer components on both bitumen froth and tailings solvent recovery feed streams, as above having viscosities in the order of 1-4 orders of magnitude greater than that of water and solids content in the order of 10 of 25%. The solids are abrasive, the effects of which are aggravated at localized high velocities. The oil sand industry has noted increased vibration when using direct condensation heating of oil sands streams with steam, the reaction being to move to supersonic steam injection velocities As introduced above, the various operational parameters, for heating slurries with steam injection, are often conflicting. Supersonic steam velocities, injected into the process fluid, can reduce vibration and improve steam energy transfer, but this also results in a significantly shorter component life when applied to abrasive, solids-bearing slurries. In the prior art, vibration has been managed by introducing the steam at high velocity, such as at sonic or supersonic velocities. Applicant understands that reduced vibration can result from a supersonic steam plume piercing and extending deep into the fluid to be heated, where steam condenses along a long, high surface area profile rather than in a shorter profile in which large bubbles collapse together. Further, supersonic velocities and erosive interface conditions can result from localized flashing of hydrocarbons, exacerbated by light solvents in the tailings feed stream.

However, injecting steam at such high velocities also appears to cause or elevate the risk of accelerated abrasive wear on components in the flow path of the steam/froth mixture, such as static mixers and the like.

With maximizing the mean time between failure of the steam injection and any mixing components as one objective, Applicant has determined that, in some instances, it may not even be required to use a static mixer to achieve the process heating requirements. Absent said static mixer, the erosion issue is significantly abated.

In other instances, Applicant has determined geometric arrangements that firstly maximize the heat transfer without vibration, secondly to reducing the erosive conditions and thereafter to tune a balance of the process heat transfer objectives using a static mixer, as necessary, located downstream of the most erosive conditions of the slurry.

Hence, steam is injected into the slurry to minimize vibration, maximize heat transfer and minimize erosion from entrained solids. Direct contact condensation results in a transfer of heat, through latent heat of condensation of water from gas to liquid, and a transfer of momentum energy which manifests in a form of a steam plume into the flow of slurry. The steam plume penetrates the slurry and advantages are achieved with controls for maintaining the steam velocity in the sub-sonic up to sonic range. The dynamics of the mixing of steam and slurry can mitigate or accentuate erosive effect of the entrained solids on the system apparatus.

Turning to FIG. 1, a system 10 is provided for injecting superheated steam S to a process stream of slurry F to produce a heated slurry FH. The slurry stream F comprises a viscous, hydrocarbon-bearing slurry. The steam S is typically provided as a lower pressure steam (such as 1100 kPa, 195° C.) or medium pressure steam (such as 3500 kPa, 245° C.). Steam S from a boiler or steam supply 12, and the slurry F, are combined in a first slurry conduit 14. The heated slurry FH, comprising entrained solids, is typically being transported to downstream treatment in the slurry conduit 14.

The steam S is typically provided from a separate, second steam conduit 16 that sealingly and laterally penetrates the slurry conduit 14 at an inlet section 17, turns at an elbow 18 within the slurry conduit 14 for aligning a steam outlet 20 with the slurry F. The steam exits at a sub-sonic velocity.

A distributor section 22 of the slurry conduit 14 comprises a bore 24 for transport of the stream of slurry F therein. The bore 24 distributor section 22 is typically provided with an erosion-resistant surface coating. The steam outlet 20 is housed in the distributor section 22 for discharging steam S. The heated steam and relatively cooler slurry converge about a steam plume P along which the steam condenses into the slurry for transfer of the superheated steam's latent heat.

The steam outlet 20 discharges steam S into an upstream portion of the distributor section 22, at least a downstream portion of the distributor section being erosion-resistant.

An optional mixing section 24 can be located downstream of the distributor section 22 for further mixing the steam, typically for reducing the length of downstream piping for the slurry conduits. The mixing section can include conventional paddle or vane-type static mixing components.

As above, in embodiments, steam S is introduced to slurry F characterized by entrained solids, viscosities greater than that of water, and including oils. The slurries comprising liquid hydrocarbon, water, and solids having moderate to high viscosities and specific gravities SG in the order of about 1.02 to 1.17 with average SG in the order of 1.08.

Herein, in embodiments, applicant has provided steam injection to mix with, condense and transfer heat to the slurry in a distributor section at sub-sonic velocities, with or without a static mixer component. The velocity of the steam is controllable to maintain a slurry/steam pressure ratio within a pre-determined range as slurry characteristics may vary including rate and composition.

In greater detail and with reference to FIGS. 2A-2D, the system 10 can comprise the fluid inlet section 17, the distributor section 22, and an optional mixing section 24. A steam outlet 20 of the steam conduit 16 terminates in the distributor section 22 and is arranged co-axial therewith. The interface between the steam conduit 16 and the slurry 14 conduit is fluidly sealed. Slurry F flows through an annulus 30 formed between the coaxial portions of the steam conduit 16 and the slurry conduit 14. The slurry F flows through annulus 30. Steam exits the steam outlet to comingle with the slurry in the distributor section 22.

Figure 2A:
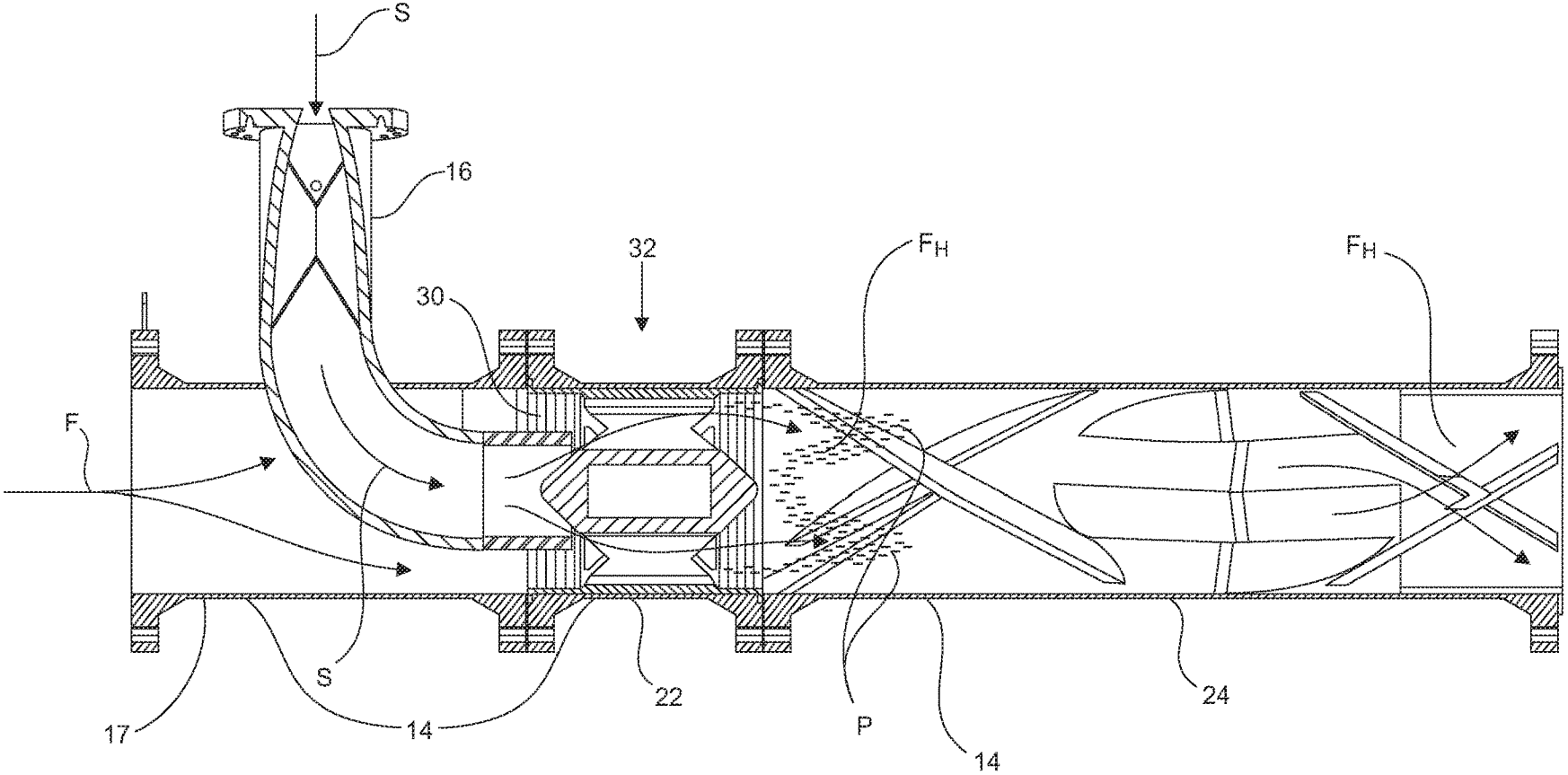
FIG. 2A is a side cross-sectional view of an embodiment of a steam injection system disclosed herein.
Figure 2B:
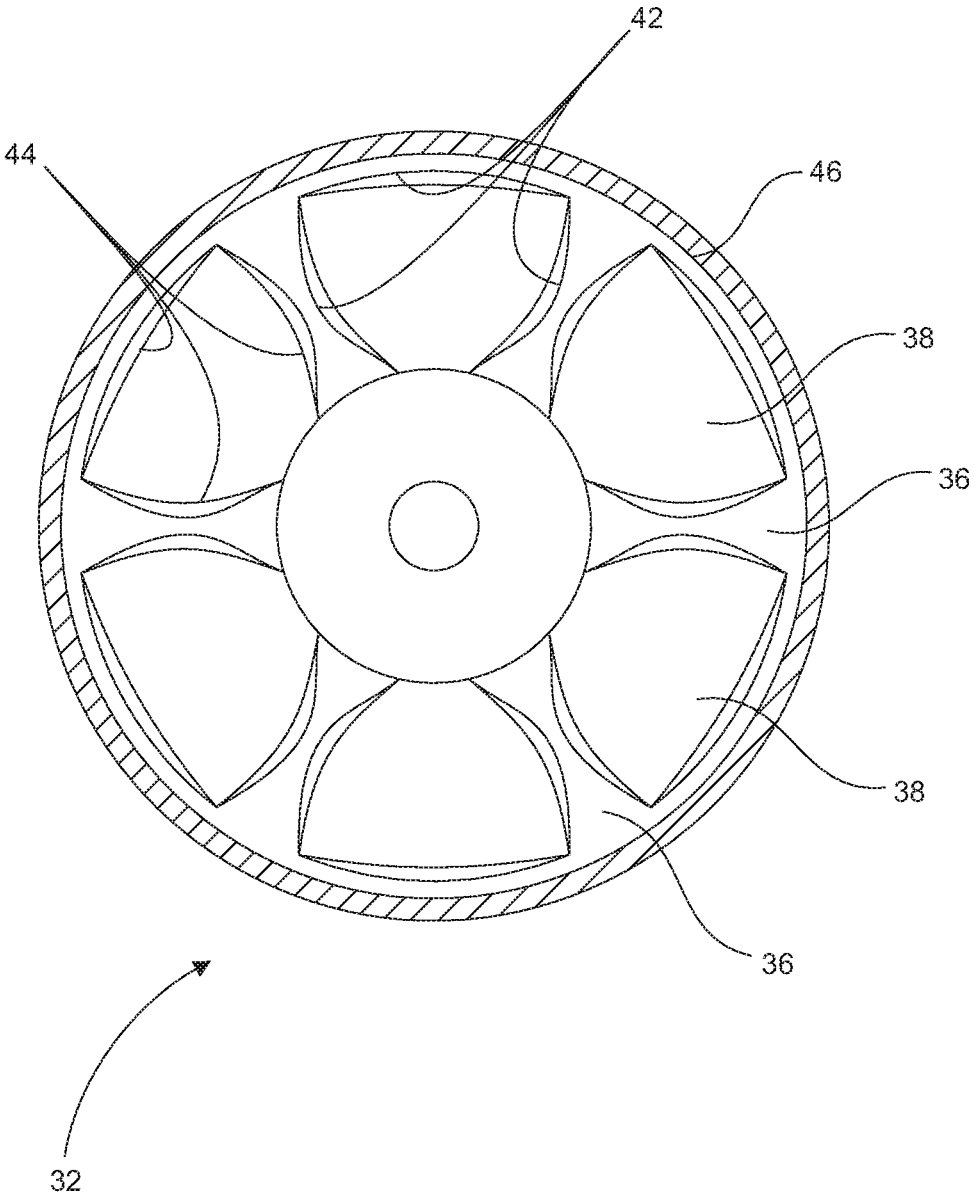
FIG. 2B is an inlet-end axial view of a distributor section and deflector of the system of FIG. 2A.
Figure 2C:
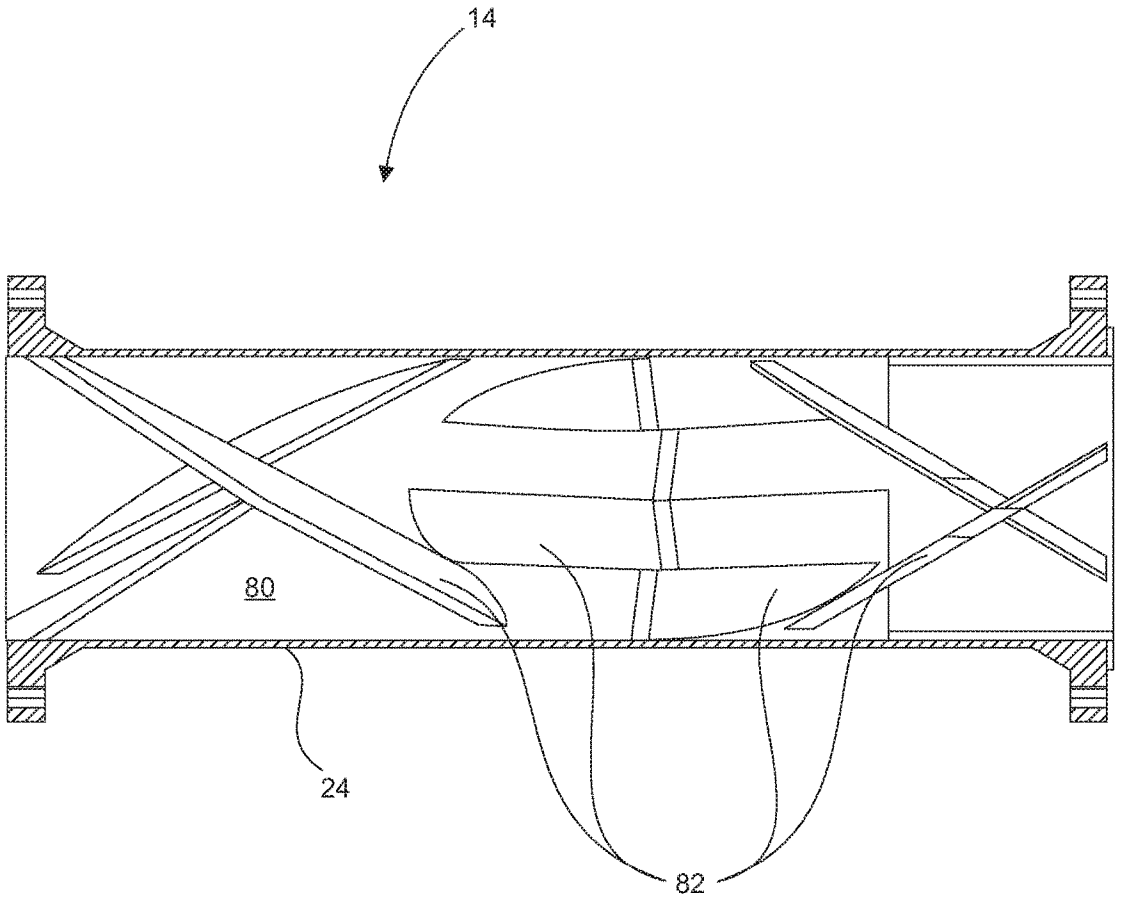
FIG. 2C is a side cross-sectional view of a wear-resistant high-efficiency static mixing section of the system of FIG. 2A.
Figure 2D:
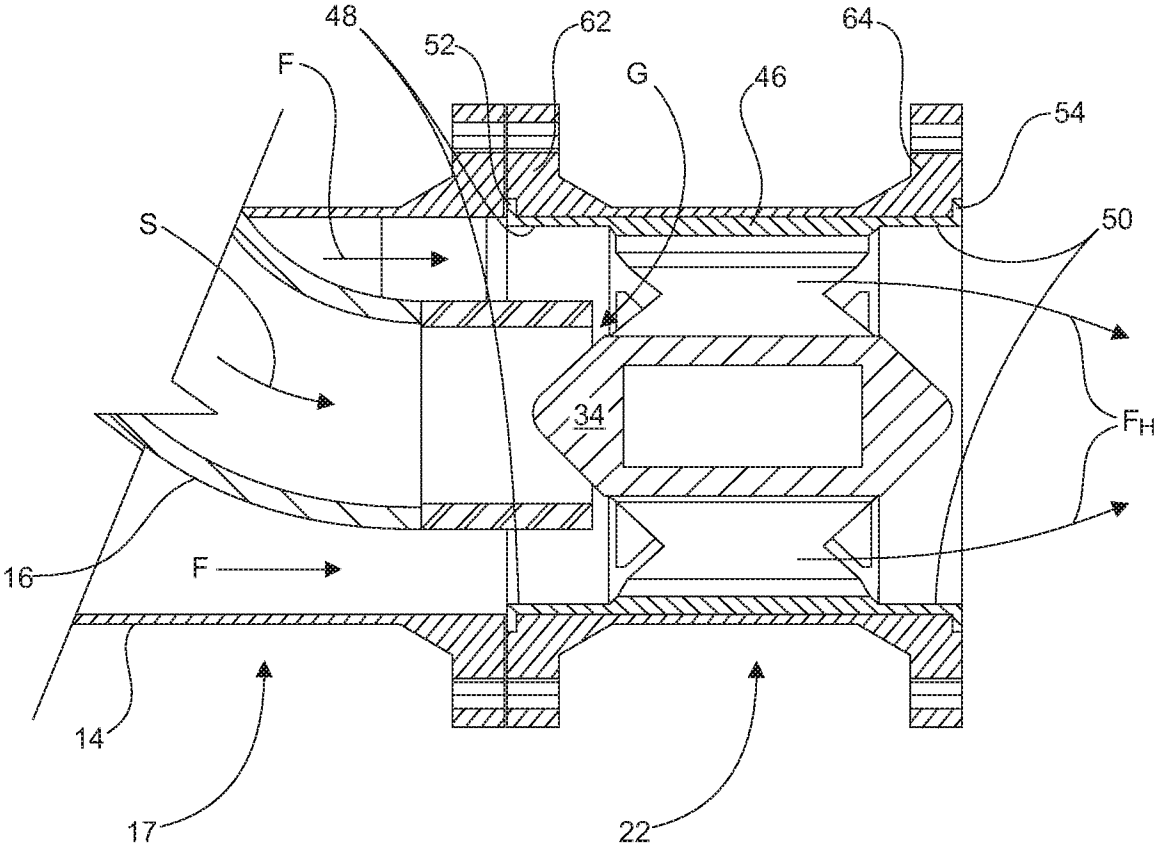
FIG. 2D is a side cross-sectional view of a distributor section of the system of FIG. 2A illustrating the annular gap of the nozzle formed between the steam outlet and the inlet deflector cone.

Referring now to the embodiment of FIGS. 2A, 2B and 2D, the distributor section 22 houses a steam nozzle 32 housed in bore 24.

As best shown in FIG. 2D, the nozzle 32 comprises an arrangement of the steam outlet 20 and a conical deflector 34. The conical deflector 34 comprises upstream and downstream right circular cones 34*i*, 34*o* joined base-to-base at a center and having leading or upstream and trailing or downstream apexes respectively, the steam being directed about the upstream cone 34*i*. In this embodiment the angle of the upstream cone is about 45°.

Deflector options include a single leading inlet deflector 34*i* or the base-to-base double conical deflector 34 having both the leading inlet deflector 34*i* and the trailing outlet deflector 34*o*. The deflector is a right circular cone and the steam outlet is a circular outlet forming an annular, circular steam discharge gap, or annular gap G. Steam exiting the steam outlet 20 is discharge through the gap G for steam flow control.

The deflector 34 is supported by a plurality of spokes 36 extending radially in an annular space between the deflector 34 and the wall of the slurry conduit 14. Between each pair of adjacent spokes 36 is formed an axially-extending fluid channel 38. Each channel 38 forms a flow path that extends generally co-axial and therefore parallel to the axis of the slurry conduit. The channels are unobstructed so as to minimize flow-induced erosion.

The inlet deflector 34*i* extends upstream into the steam outlet 20. The outlet deflector 34*o* extends downstream and mitigates erosive eddies and turbulence as the mixture of steam S and slurry F mixture exits the plurality of channels 38. The base-to-base deflector has a maximal diametral extent at the base.

In the embodiment shown in FIG. 2B, the channels 38 each have a curvilinear trapezoidal profile. The channels can be tapered from an upstream inlet 42 to a smaller downstream outlet 44. The tapered channels can aid in converging the discrete steam plumes P before the plumes combine downstream along the slurry conduit 14.

The deflector 34 and related structure, including the spokes 36, are preferably coated with, surface treated or otherwise rendered more erosion-resistant, such as with tungsten carbide in a nickel or cobalt matrix, or other ceramic metal matrix composites (MMCs), to withstand the erosive forces of the mixing system. For example, the deflector nozzle can be formed of tungsten carbide MMC by hot isostatic pressing, or be made of steel and hard-faced with tungsten carbide MMC via plasma transfer arc welding, sintering, laser cladding, or other hard-facing methods known in the art. While erosion-resistant castings can be used, casting defects may result in shorter component life.

In the embodiment depicted in FIGS. 2A, 2B and 2D, the nozzle 32, including the deflector 34 and supporting spokes 36 are supported within a cylindrical housing 46. For ease of replacement, the cylindrical housing 46 supporting the nozzle is axially insertable into the distributor section 22 of the slurry conduit 14 and retained axially therein by first and second sleeves 48, 50. The first and second sleeves each have cylindrical sleeve portions abutting opposing ends of the cylindrical housing and respective flanged ends 52,54 for retention at respective flanged interfaces 62,64 of the distributor section 22. The material of housing 46 can be unitary and integral with that of the spokes 36 and deflector 34. The sleeves 48,50 are separately insertable and can be independently rendered erosion-resistant as described above, including material selection or surface treatment. As shown, a representation of circumferential cladding or hard-facing technique.

As one of skill in the art would understand, the nozzle 32 can be retained in the distributor section 22 by a variety of other methods known in the art. For example, the structure of the nozzle 32 itself or the cylindrical housing 46 can be integrate or fit with one or both shoulders or flanges 52,54. The flanges are sandwiched at the distributor to intake section interface.

With reference to FIG. 2D, the annular gap G is formed between the circular steam outlet 20 and inlet deflector 34*i*. The annular gap G is sized to provide a desired steam output velocity and pressure ratio between the back pressure of the slurry Pb upstream of the steam outlet 20 and supplied steam pressure Po. In a preferred embodiment, the butt end of the steam outlet is square, i.e. perpendicular to the axis of the coaxial portion, in order to further reduce the velocity of the steam flowing through the annular gap G, thereby mitigating erosion.

Applicant provides a slurry conduit 14 and steam conduit 16 for the mass rates of flow based on the heat balance for the given process fluid flow and temperature conditions. High process flow rates may be divided between two or more parallel slurry conduits 14,14 . . . . Further, to avoid supersonic steam velocities, the necessary mass rate of flow of steam is delivered at an introduction interface to the flow of the slurry based on a ratio of the slurry back-pressure and steam supply delivery pressure.

Applicant has determined that the steam injection velocity can be managed to a sub-sonic velocity by controlling the ratio of the slurry back pressure Pb, upstream of the steam outlet 20 or nozzle 32, to the steam supply pressure Po. Applicant has determined that pressure ratio Pb/Po can be maintained within a range that results in a sufficiently low steam velocity so as to manage erosion, while maintaining a sufficiently high steam velocity, for the slurry characteristics and nozzle design to avoid excessive vibration.

As introduced above, the geometry of the nozzle 32 forms one or more steam plumes. Applicant has determined that as the viscosity of the slurry F increases, the maximum penetration depth of the steam plume P into the slurry F, for a given steam velocity, decreases and vibration increases. A response is to inject steam at higher and higher velocities, so as to form a long enough plume to distribute the condensation collapse and provide a sufficient steam condensation interface or surface area to avoid vibration.

For highly viscous slurries (in the range of 3 to 4 orders of magnitude greater than that of water), for example as is the case with bituminous froth, and so as to pierce the viscous slurry with the steam plume P, the preferred pressure ratio can be tuned to favor higher velocities so as to form a steam slurry interface that is less vulnerable to vibration. The correspondingly larger steam pressure Po, as the denominator, results in lower ratios in the range of 0.55 to about 0.7. For moderate viscosity slurries, such as tailings feed streams, less resistant to favorable steam plume P interfaces, a wide range of high velocities through lower velocities all result in steam plumes that are less susceptible to vibration, resulting in a wider operation range of ratios between 0.55 to about 0.88.

Injection of steam S, transverse to the flow of slurry F provides more mixing energy. As shown, with a nozzle deflector at 30° to 45°, the steam engages the conical deflector and exits at an angle to form a conical plume with a vector that mixes and disburses energy into the intercepting slurry flow. The steam S flows radially outward at an angle towards the walls of the slurry conduit 14 or housing 46 of the embodiment of FIG. 2A. If the steam S flow is well distributed about the flow axis, it is intercepted by the slurry F and the flow vector turns downstream before it can adversely impact the conduit walls and the mixture of heated slurry flows downstream.

At these sub-sonic mixing velocities, the bulk temperature T of the slurry may not yet be at the design temperature at a target downstream location. Accordingly, a static mixing section 24 can be employed to reduce the length of conduit required. The heated slurry mixture FH can be further directed through an efficient static mixer for homogenization of the heated slurry product. Such an installation is downstream of the aggressive mixing and protected from cavitation issues and direct impingement of the abrasive erosive effects of high velocity steam and entrained solids.

The optional static mixer 24 operational parameters are a function of steam rate, determined by the differential pressure across the steam nozzle and the Pb/Po ratio. Ratios that meet Applicant's objectives fall generally in the preferred range of about 0.55 to about 0.88. Ratios lower that the preferred ratios were found to risk entering the supersonic range, while ratios greater than the preferred ratio could result in steam velocities so low enough to cause steam plume failure, significant cavitation and hammering.

In embodiments the steam nozzle and slurry contact can be conducted contemporaneous with the localized increase in steam velocity, and in other embodiments the steam velocity is locally increased within a shrouded nozzle before introduction to the slurry.

In embodiments, a nozzle having a conical deflector, supported at a plurality of radial spokes forming a plurality of circumferentially spaced channels, can be located in the distributor section for radially distributing the flow of steam or steam/bitumen mixture. The channels are preferably unobstructed so as to avoid fluid channeling and premature erosion of structures therein. The ratio of froth/slurry pressure to steam pressure to can be maintained within a desirable range such that the velocity of the steam exiting the steam conduit through a steam outlet is sub-sonic to sonic. The velocity control mitigates erosion, but remains high enough to avoid significant vibration caused by cavitation. The pressure ratio range can be set prior to installation, or adjusted in-situ during operation, by varying the steam pressure or in other embodiments the cross-sectional area of the passageway through which steam passes before contacting the bitumen.

Figure 3A:
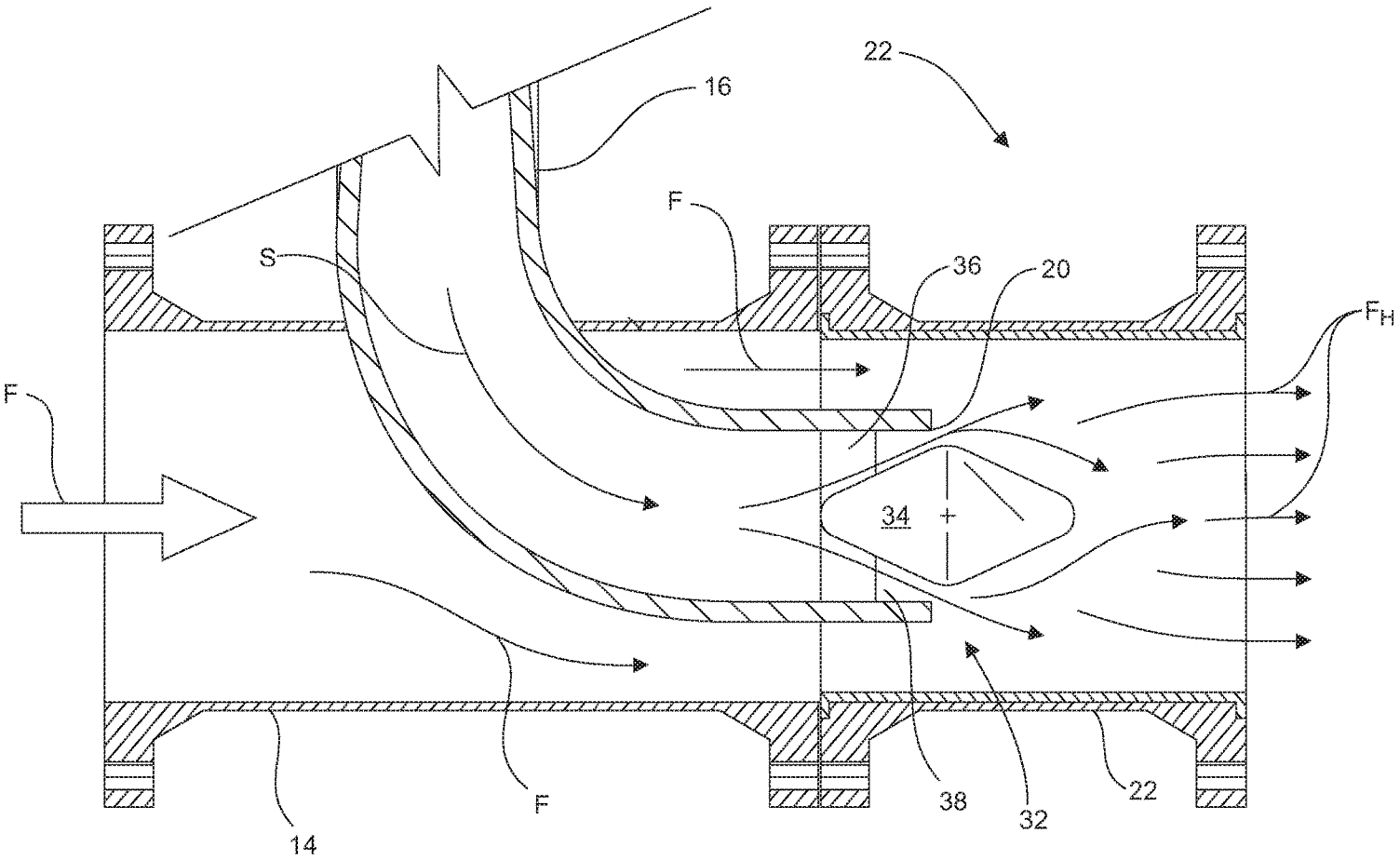
FIG. 3A is a side cross-sectional view of an alternative embodiment of a system wherein the nozzle is supported from the steam conduit.
Figure 3B:
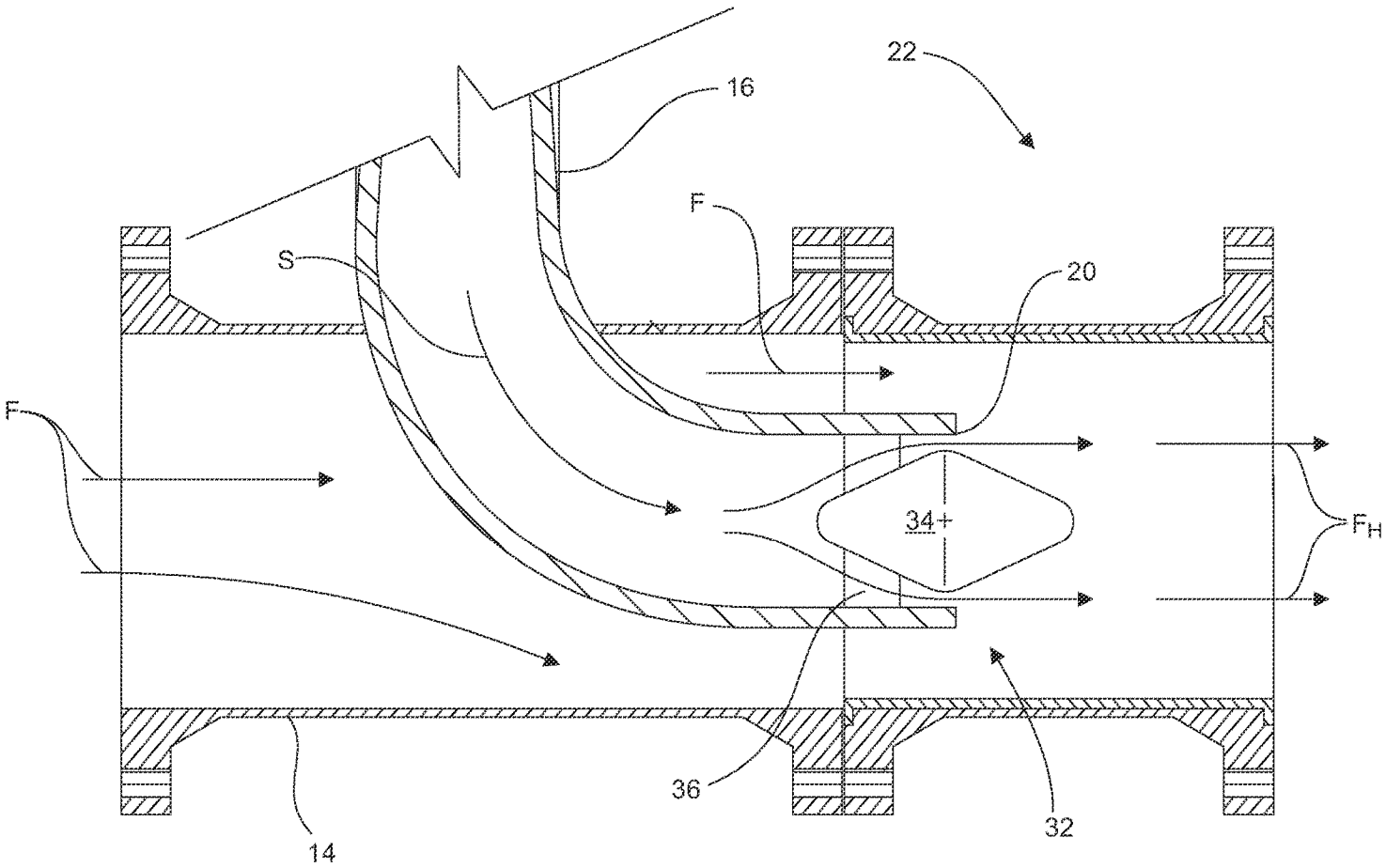
FIG. 3B is a side cross-sectional view an alternative embodiment of the embodiment of FIG. 3A wherein the conical deflector portion of the nozzle is further recessed upstream from the steam outlet and into the steam conduit.
Figure 3C:
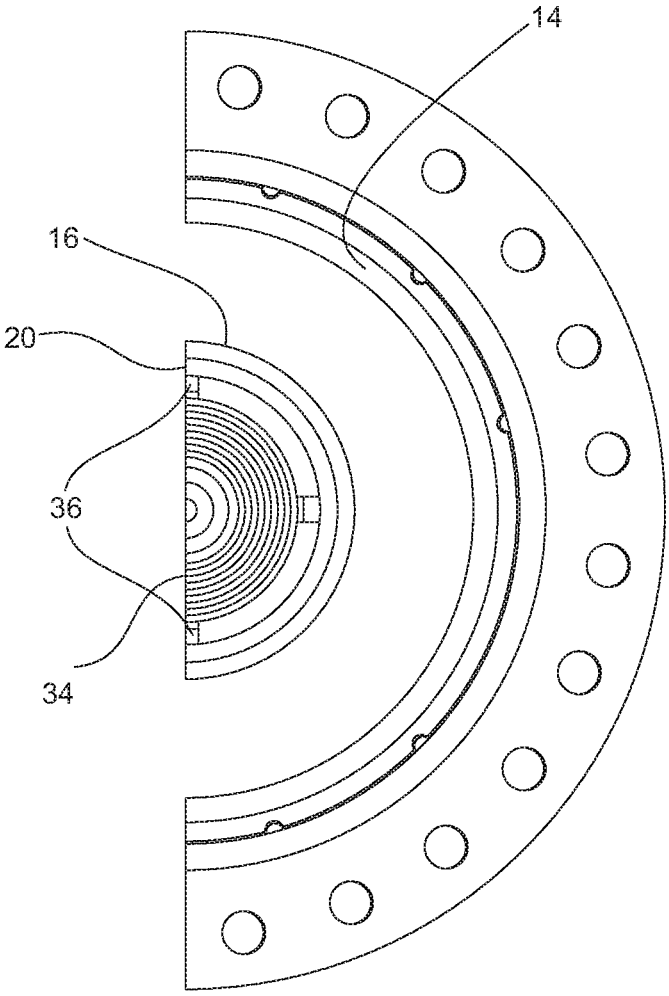
FIG. 3C is an upstream view end view of the distributor section according to of FIG. 3B, illustrating the annular gap formed at the deflector center portion.

In alternative embodiments, as shown in FIGS. 3A to 3C, the nozzle can be incorporated into the steam outlet. As shown the deflector 34 can be coupled with the outlet 20 of the steam conduit 16 such that only steam S passes through the plurality of channels 38. In this embodiment, the angle of the upstream or leading conical deflector is about 30° with steam flow vectors of between about 0° and 30° for FIGS. 3A and 3B respectively, depending on the depth of axial insertion into the steam outlet. The angles are measured from the deflector axis which happens to be coincident with the axis of the steam conduit 16 and steam outlet. Such embodiments are advantageous, as the spokes 36 and other upstream areas of the nozzle are only exposed to the dry superheated steam, which is non-erosive or far less erosive than the steam/slurry mixture of earlier embodiments.

Accordingly, rather than a gap area design, the flow area of channels 38 can be selected in order to provide the desired pressure ratio Pb/Po, and consequently, the desired steam velocity.

As shown in FIG. 3B, the largest diameter center portion of the distributor 34 can be located further upstream in the steam conduit 16, within the steam opening 20 such that the center of gravity of the nozzle 32 is closer to its point of connection with the steam conduit. In one aspect, the flow lines of the steam existing the nozzle and forming steam plumes is more horizontal or co-axial with the axis of the steam conduit, and distributor section 22. Further, the deflector is even more protected from the slurry and mixtures thereof.

Figure 4:
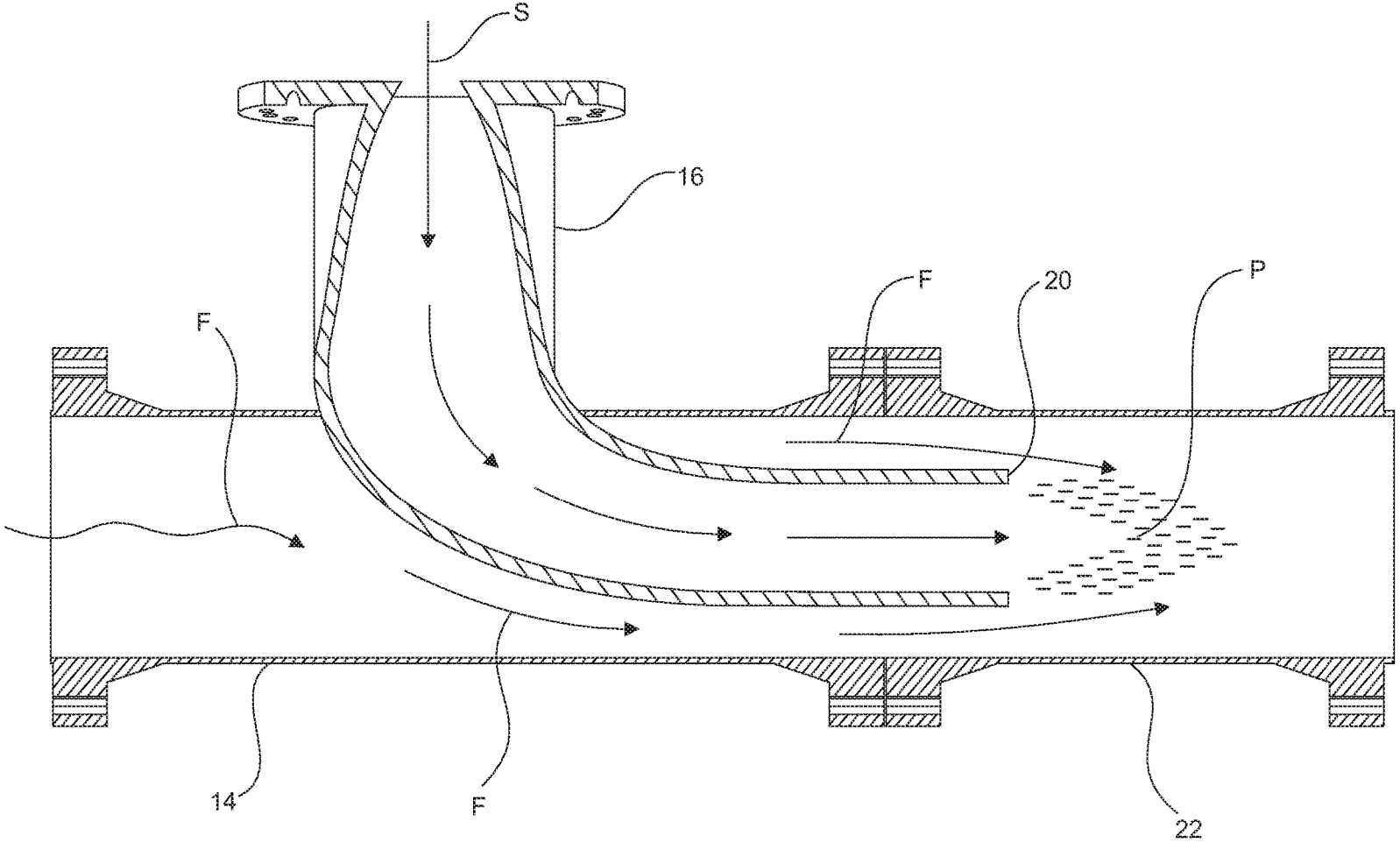
FIG. 4 is a side cross-sectional view of an alternative embodiment of a system having an open steam outlet with no nozzle in the distributor section, as applied to moderate viscosity oil sand process slurries.

In further alternative embodiments, as shown in FIG. 4, the nozzle can be omitted entirely from the distributor section and the steam outlet of the steam conduit can be sized to provide the desired pressure ratio Pb/Po. Such embodiments are suitable for applications in which the viscosity is above that of water, but moderate, such as in the case of a tailings feedstream slurry, in the order of 8-10 cP. The nozzle is simplistic, but substantially immune to erosion and vibration is the required Pb/Po ratio is maintained. If there is a physical limitation on the length of the slurry conduit, downstream of the distributor section 22, then the option mixer section 24 can be employed to tune the mixing and heated slurry temperature objectives.

Figures 6A, 6B:
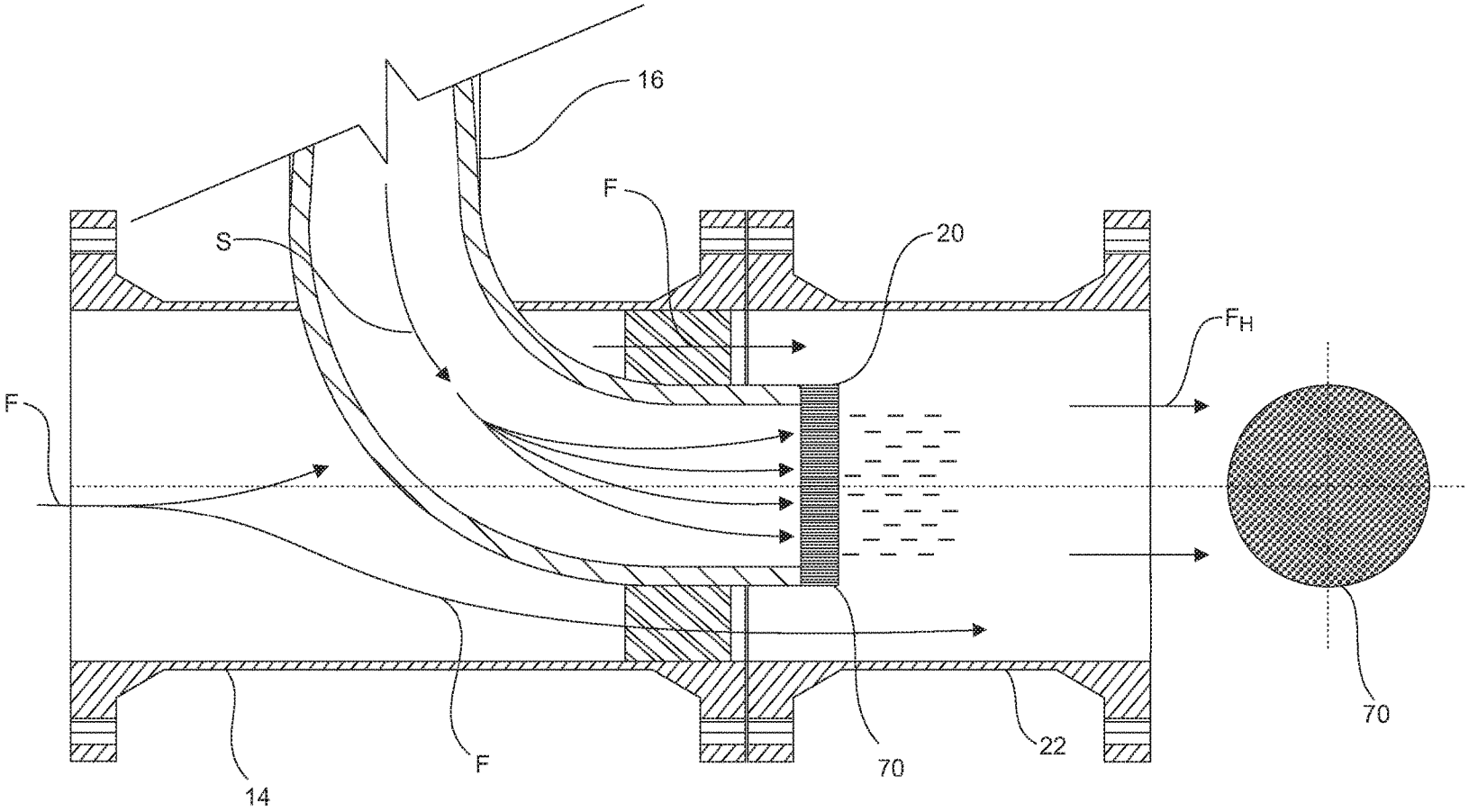

In further alternative embodiments, as shown in FIGS. 6A and 6B, the steam outlet 20 of the steam conduit 16 can be fit with a perforated plate 70 to form the nozzle 32, producing a multiplicity of steam outlets and steam plumes. The perforations 72,72, of the plate 70 can be of any suitable geometry and size, and be arranged in any suitable pattern on the plate, to provide the desired pressure ratio Pb/Po. While suitable for both moderate and high viscosity slurry applications, the throughput could be limiting resulting in the implementation of multiple parallel steam injector trains.

Returning to FIG. 2C, the mixing section 24 is a generally tubular section of pipe having a mixing bore 80 and mixing elements 82 therein for enhancing heat transfer between unmixed steam S and slurry F in the heated slurry FH. In the depicted embodiments, the mixing elements are angularly offset arrays of interdigitating elements spanning the mixing bore 80. As shown, the mixing section 24 comprises three arrays of elements 82, each array angularly offset from an adjacent array by about 90 degrees, thus providing a convoluted flow path for the steam/bitumen froth mixture to travel. In alternative embodiments, other mixing elements can be used to improve heat transfer.

Figure 5:
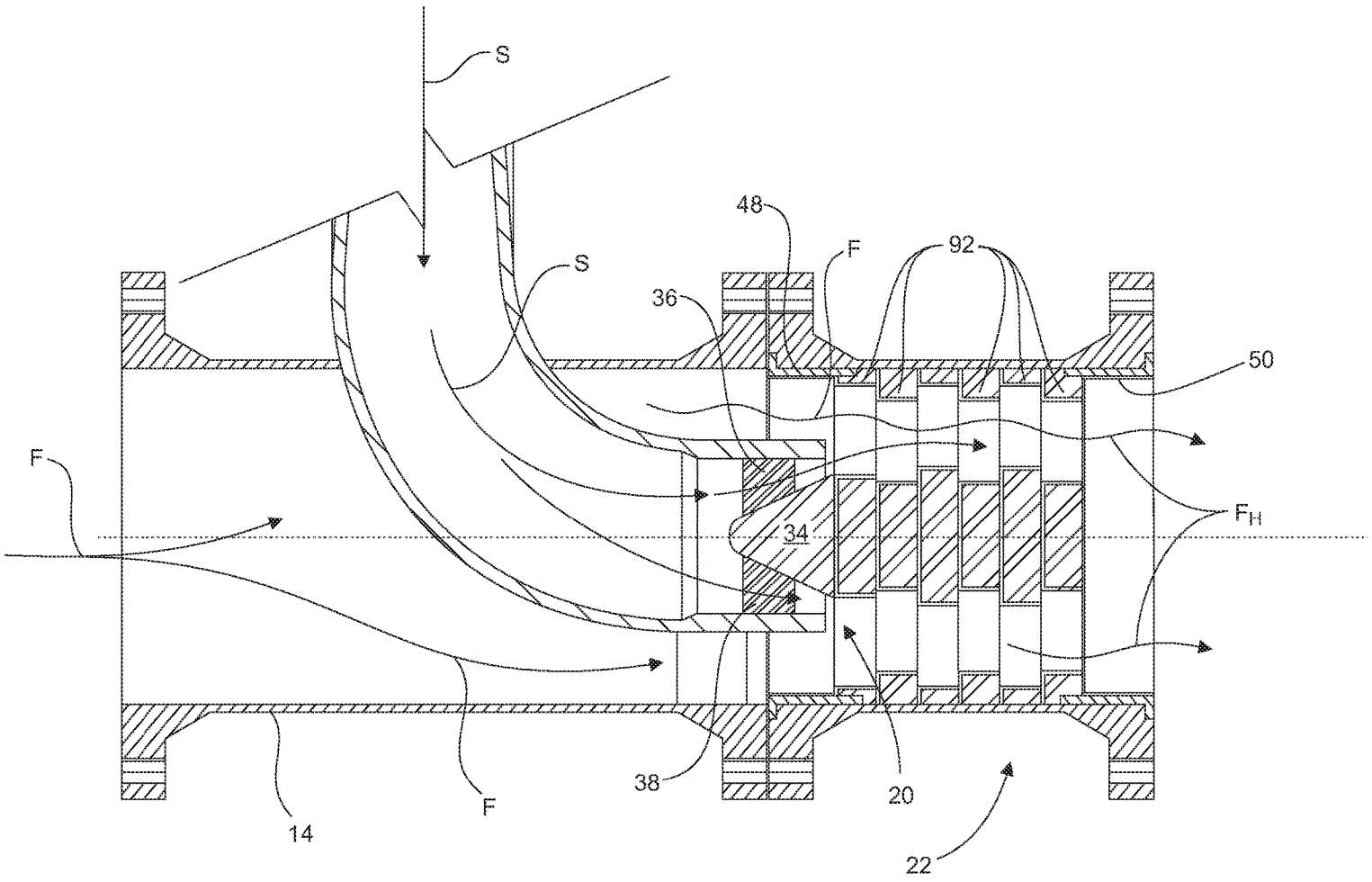
FIG. 5 is a side cross-sectional view of an alternative embodiment of a system wherein the distributor section is fit with replaceably aperture plates which are alternating for forming serpentine flow paths downstream of the nozzle.

For example, as shown in FIG. 5, the channels 38 of the nozzle can be extended with a series of radially offset apertures 90 to provide a serpentine mixing path for the heated slurry FH. A plurality of circumferentially spaced apertures 90 are formed through in each of a series of transverse plates 92. The plates 92, are in an highly erosive environment, and can be provided with erosion-resistant surfaces 94, and further can be easily releasably-secured and replaceable using sleeves 48,50 as discussed for the embodiment of FIG. 2D.

If space allows for a long slurry conduit 14 downstream of the above nozzles 32, the mixing section 24 can be omitted and the mixture of steam and slurry to reach a homogenous mixture as it flows through the slurry conduit 14.

As shown in FIG. 1, pressure sensors for Pb and Po can be located in at inlet section 17 and steam conduit respectively and provide feedback to a control system 100 and steam control valve 102.

Pressure Ratio

To mitigate cavitation, the pressure ratio Pb/Po between back pressure Pb and steam pressure Po can be maintained within a range that results in a sufficiently low steam velocity to reduce erosion, while maintaining a sufficiently high steam velocity to avoid excessive vibration due to cavitation. For higher viscosity slurries such as bitumen froth, the preferred pressure ratio provides steam velocities in the sub-sonic to sonic range, while for moderate viscosity, lower hydrocarbon and solvent containing slurries, such as tailings slurries, the preferred pressure ratio provides steam velocity throughout in the sub-sonic range.

Figure 7:
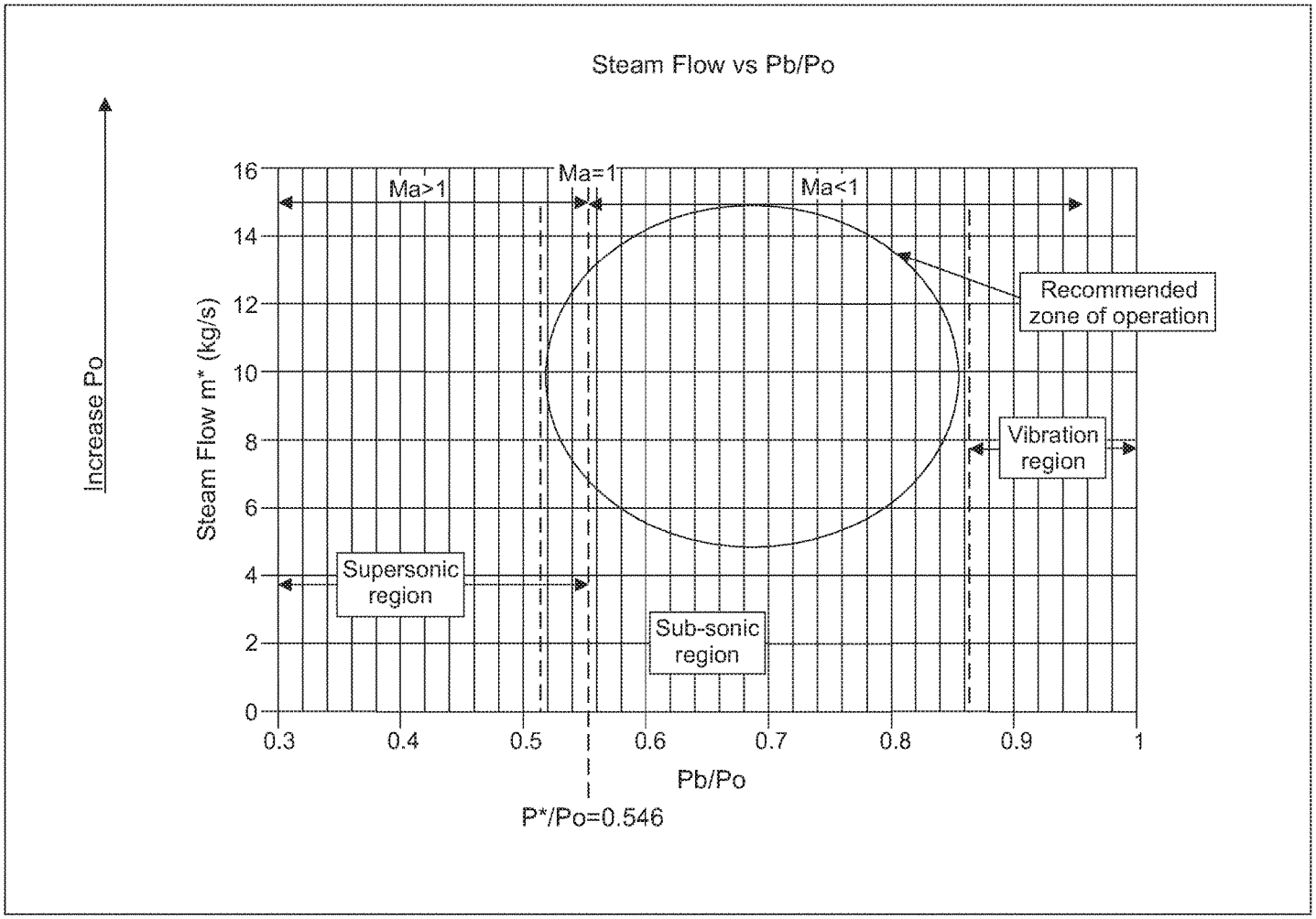
FIG. 7 is a graph illustrating the managed pressure ratio range between slurry back-pressure Pb and steam pressure Po so as to avoid supersonic steam velocities.

Through simulations and testing, as shown in FIG. 7, it has been found that a Pb/Po ratio within the range of 0.546-0.880 is desirable, as a Pb/Po ratio of 0.546 or lower results in steam velocity entering the super-sonic range, and a Pb/Po ratio of 0.880 or higher results in steam velocities slow enough to form large bubbles and cause significant cavitation and hammering.

As nominal steam pressure Po and slurry back pressure Pb is typically dictated by plant and process requirements, often the most effective way of adjusting the Pb/Po ratio is to adjust the cross-sectional flow area or gap G of the passageway through which steam is introduced to the bitumen froth. Increasing the cross-sectional area decreases the velocity of the steam flowing therethrough and decreases pressure Po, thus increasing the Pb/Po ratio. Conversely, decreasing the cross-sectional area increases steam velocity, increases pressure Po, and decreases the Pb/Po ratio.

By example, the Pb/Po ratio can be adjusted by varying the cross-sectional flow area of the annular gap between the inlet cone and steam outlet for the embodiment shown in FIGS. 2A, 2B and 2D, the cross-sectional flow area of the plurality of channels for the embodiments shown in FIGS. 3A through 3C, and the cross-sectional flow area of the steam outlet itself in the embodiment shown in FIG. 4.

Adjustment of the cross-sectional flow area can be achieved using any method known in the art. For example, for the embodiment shown in FIGS. 2A, 2B and 2D, to increase the size of the annular gap, the nozzle can be moved further away from the steam outlet or the inlet facing cone of the nozzle portion can be made shorter or taper more quickly towards its apex. For the embodiments shown in FIGS. 3A to 3C, where no annular gap is present, the flow area of the plurality of channels of the nozzle can instead be sized to provide the desired Pb/Po ratio. Where no cone is present, such as in the embodiment shown in FIG. 3, the diameter of the steam outlet can be selected to provide the desired Pb/Po ratio.

Adjustment of the cross-sectional flow area can also be achieved in-situ during operation using a mechanical or pneumatic mechanism that moves the cone closer or further away from the steam outlet, depending on the process conditions, in order to maintain the desired Pb/Po ratio. For example, the cone can be operatively connected to a drive mechanism external to the mixing system, such as a lever, configured to move the cone closer to the steam outlet when actuated in a first direction, and move the cone farther away from the steam outlet when actuated in a second direction. The drive mechanism could be operable in any suitable manner known in the art, such as manually, by a motor, or by a pneumatic drive.

The controller 100, receiving pressure readings from the pressure sensors, can be operatively connected to the drive mechanism and be configured to actuate the drive mechanism and adjust the position of the cone accordingly in response to the measured Pb/Po pressure ratio. Such an in-situ adjustment mechanism is advantageous, as it enables adjustment of the Pb/Po ratio without cessation of operation.

Mechanical devices, such as linkages to displace the steam conduit 16, or the deflector 34, or variable deflector diameters for example for affecting variance of the gap G, can introduce additional complexity and risk of leakage at envelope intrusions. Accordingly, the maximum and minimum slurry flow conditions can be used to pre-determine or establish the nozzle and distributor section parameters so as to provide stream outlet sub-sonic velocities for a nominal slurry flow condition and available steam supply pressure sand delivery rates. The design permits at least some steam pressure turndown to permit control of the pressure ration Pb/Po to accommodate variations in feed slurry flow and constituents, including water fraction. The steam pressure turndown permits automatic or manual control to maintain the Pb/Po ratios and avoid supersonic steam velocities through a given nominal gap G area.

Example Process

In an example process, for a high viscosity slurry F of bitumen froth at about 8,000 to 10,000 cP, and if the mixing system is to achieve a target bitumen froth temperature of 80° C., steam can be introduced through the steam conduit at a temperature of about 185° C. at a steam pressure Po of 750 kPag and 42 tons/h to heat bitumen froth flowing into the bitumen conduit at 50° C. with a back-pressure Pb of 450 KPag (Pb/Po=0.6) and 1800 $m^3$/h.

Typically, first slurry conduit 14 and second steam conduit 16 have walls of circular cross-section. The steam conduit 16 extend generally transversely through the slurry conduit wall and is curved so that steam flow from the steam outlet 20 is aligned with the flow of the slurry from the slurry conduit 14.

For a slurry conduit internal diameter (ID) of about 570 mm, a steam conduit can have an outer diameter (OD) of about 320 mm and an ID of about 260 mm. Depending on the axial positioning of the deflector, the maximum diameter, at the axial center of the conical deflector, varies. The length can also vary to adjust the conical angle.

With reference to FIG. 3A, with the center extent (maximum diameter) of the deflector 34 axially downstream of the steam outlet 20, the deflector can be larger. A deflector center OD can be about 230 mm and inserted upstream into the steam outlet 20 until the annular gap G between the inside ID of the steam outlet and angled wall of the deflector narrows to about 21 mm. A deflector back-to-back conical design has an axial extent of about 450 mm for an angle of about 27°. With reference to FIG. 3B, with the center extent of the deflector 34 fully within the steam outlet 20, the deflector OD has a smaller OD and the axial center OD sets the annular gap G. A 26 mm plateau at the axial center can aid in flow straightening. A deflector axial center OD of 210 mm can be fully inserted upstream into the steam outlet 20 for an annular gap of about 25 mm. The double conical deflector can have a length of about 410 mm for an angle of 27°.

The aforementioned arrangements provide a sub-sonic steam output velocity while avoiding significant vibration due to cavitation.

Preferably, to avoid thermal shock which can cause ceramic components of the nozzle 32 to fracture, start-up procedures are employed wherein the nozzle components are not permitted to be accidentally pre-heated to 200° C. by steam and then quickly quenched by cold bitumen froth introduced at temperatures of 40-50° C.

The embodiments for which an exclusive property or privilege is claimed are defined as follows:

1. A system for direct steam injection to heat a viscous oil sand process slurry, the slurry comprising hydrocarbons, water and solids, comprising:

a first slurry conduit having a first bore for conducting the slurry therealong at a first pressure; and a second steam conduit, having a steam outlet situate within the first slurry conduit, for co-injecting superheated steam therefrom and directed downstream into the viscous slurry at a second pressure; and a steam and slurry distributor section along the first slurry conduit, the steam outlet discharging steam into an upstream portion of the distributor section, at least a downstream portion of the distributor section being erosion resistant;

wherein the steam is discharged from a nozzle, the nozzle comprising the steam outlet and a conical deflector for forming an annular steam discharge gap therebetween;

wherein the conical deflector comprises a portion of the distributor section;

wherein the distributor section further comprises a plurality of axially extending fluid channels circumferentially spaced about the conical deflector; and wherein each channel of the plurality of fluid channels comprises an upstream inlet and a downstream outlet, and each channel is tapered from the upstream inlet toward the downstream outlet.

2. The system of claim 1, wherein the second conduit is co-axial with the first conduit for parallel discharge of the steam into the slurry.

3. The system of claim 1, wherein the second conduit is co-axial with the first conduit for discharge of the steam along an elongated steam plume into the slurry.

4. The system of claim 1, wherein the first conduit and second conduits have first and second walls of circular cross-section, the second conduit extending generally transversely through the first wall and curved so that the steam outlet from second conduit is aligned with the flow of the slurry in the first conduit.

5. The system of claim 1, wherein the nozzle has a discharge axis co-axial with an axis of the first conduit.

6. The system of claim 1, wherein the viscous slurry is a froth settling tailings product as a tailings feedstream to a tailings solvent recovery process.

7. The system of claim 6, wherein tailings feedstream has a viscosity of 8 cP or greater.

8. The system of claim 6, wherein the viscous slurry is a tailings feedstream to a tailings solvent recovery process.

9. The system of claim 8, wherein tailings feedstream has a viscosity of 8 cP or greater.

10. The system of claim 1, wherein the slurry has a viscosity at least 5 times that of water, and a pressure ratio of the first pressure to the second pressure is between 0.55 and 0.9.

11. The system of claim 1, wherein the steam discharge nozzle has a circular discharge end and the conical deflector is a right circular cone concentric within for forming the annular discharge gap therebetween.

12. The system of claim 11, wherein the conical deflector comprises upstream and downstream right circular cones joined base-to-base at a center and having upstream and downstream apexes respectively, the steam being directed about the upstream cone.

13. The system of claim 12, wherein the steam outlet terminates axially intermediate the upstream apex of the upstream cone and the conical deflector axial center for directing the discharging steam downstream and radially outwards along the deflector.

14. The system of claim 10, wherein the upstream cone has an angle at about 27 to about 45 degrees from the deflector axis.

15. The system of claim 10, wherein the upstream conical deflector has an angle at about 30 degrees from the deflector axis.

16. The system of claim 1, wherein the viscous slurry is a bitumen froth.

17. The system of claim 16, wherein the bitumen froth has a viscosity of about 8,000 to 10,000 cP.

18. The system of claim 1 further comprising a static mixer installed to the first conduit, downstream of the fluid distributor section.

19. The system of claim 1, wherein the conical deflector is secured to the first steam conduit.

20. The system of claim 1, wherein the conical deflector is secured to the second steam conduit.

21. The system of claim 1, wherein the conical deflector is axially movable relative to the steam outlet for adjusting the steam discharge gap.

22. A method for direct steam injection to heat a viscous oil sand process slurry, the slurry comprising hydrocarbons, water and solids, comprising:

flowing the slurry along a first conduit having a first bore for conducting the slurry therealong at a first pressure;

injecting steam into the slurry via a second steam conduit having a steam outlet situate within the first conduit, the steam being discharged from a nozzle comprising the steam outlet and a conical deflector for forming an annular steam discharge gap therebetween, wherein the steam is injected at a superheated steam supply pressure and temperature;

discharging the steam from the steam outlet into an upstream portion of a steam and slurry distributor section disposed along the first slurry conduit, at least a downstream portion of the distributor section being erosion resistant;

wherein the conical deflector comprises a portion of the distributor section, wherein the distributor section further comprises a plurality of axially extending fluid channels circumferentially spaced about the conical deflector; and wherein each channel of the plurality of fluid channels comprises an upstream inlet and a downstream outlet, and each channel is tapered from the upstream inlet toward the downstream outlet;

measuring the first pressure of the slurry upstream of the steam injection; and maintaining a velocity of the injected stream from the nozzle to a subsonic to about a sonic velocity.

23. The method of claim 22, further comprising adjusting one of the annular steam discharge gap and steam supply pressure, or a combination thereof, to maintain an operational ratio of the first pressure to steam supply pressure between about 0.55 and about 0.9.

* * * * *